US007065805B1

(12) United States Patent
Sundberg

(10) Patent No.: US 7,065,805 B1
(45) Date of Patent: Jun. 27, 2006

(54) BATHING APPARATUS

(75) Inventor: Brian Sundberg, Chester, NH (US)

(73) Assignee: Summerinfant, Inc., Slatersville, RI (US)

( * ) Notice: Subject to any disclaimer, the term of this patent is extended or adjusted under 35 U.S.C. 154(b) by 277 days.

(21) Appl. No.: 10/652,626

(22) Filed: Aug. 29, 2003

Related U.S. Application Data

(60) Provisional application No. 60/407,722, filed on Sep. 3, 2002.

(51) Int. Cl.
*A47K 3/024* (2006.01)

(52) U.S. Cl. ..... 4/572.1; 297/51; 297/256.12; 297/256.13; 297/256.15; 297/DIG. 11; 5/102; 5/103

(58) Field of Classification Search ..... 4/571.1, 4/572.1, 573.1, 586, 587, 621; 5/9, 101–103, 5/99.1; 297/19, 51, DIG. 11, 250.1, 256.1, 297/256.11, 256.12, 256.13, 256.15
See application file for complete search history.

(56) References Cited

U.S. PATENT DOCUMENTS 2,988,136 A * 6/1961 Kowalczyk ..... 297/311
4,188,678 A * 2/1980 Rawolle ..... 5/105
4,234,226 A * 11/1980 Colby ..... 297/21
4,295,683 A * 10/1981 Dubbink et al. ..... 297/377
4,719,653 A * 1/1988 Bishop et al. ..... 4/572.1
D297,685 S * 9/1988 Wilson ..... D6/348
5,451,095 A * 9/1995 Riback ..... 297/354.12
5,509,721 A * 4/1996 Huang ..... 297/452.13
5,520,435 A * 5/1996 Fujimoto et al. ..... 297/61
5,617,594 A * 4/1997 Chien ..... 5/102
5,868,459 A * 2/1999 Welsh, Jr. ..... 297/32
5,947,552 A * 9/1999 Wilkins et al. ..... 297/16.1
6,217,116 B1 * 4/2001 Sloot ..... 297/397
6,250,712 B1 * 6/2001 Livington et al. ..... 297/4
6,341,816 B1 * 1/2002 Chen et al. ..... 297/16.1
6,361,106 B1 * 3/2002 Huang ..... 297/32
6,616,225 B1 * 9/2003 Graff ..... 297/229
6,679,779 B1 * 1/2004 Tai et al. ..... 472/95
6,902,230 B1 * 6/2005 Chen ..... 297/16.1

* cited by examiner

*Primary Examiner*—Justine R. Yu
*Assistant Examiner*—Huyen Le
(74) *Attorney, Agent, or Firm*—IP Strategies

(57) ABSTRACT

An apparatus for supporting an infant in a bathtub includes a base, a fabric frame, a frame support, and a fabric cover. The base has a peripheral structure and an inner aperture. The fabric frame defines first and second planes forming a frame angle. The fabric frame is coupled to the base at the frame angle. The frame support is coupled to the base and to the fabric frame. The fabric cover is removably attached to the fabric frame.

41 Claims, 7 Drawing Sheets

BATHING APPARATUS

CROSS REFERENCE TO RELATED DOCUMENTS

This disclosure is related to, claims the priority benefit of, and incorporates by reference in its entirety, U.S. Provisional Patent Application Ser. No. 60/407,722, filed on Sep. 3, 2002, by Brian Sundberg.

BACKGROUND

Infants, as well as some adults, have special care needs with respect to feeding, transportation, and hygiene. Focusing on hygiene, and bathing in particular, numerous products are available for use in bathing babies, including special tubs and bathing accessories. For example, FIGS. 1 and 2 show a portable baby bathtub that is small in scale, folds for storage or transport, and has an inclined surface to support the baby during the bathing process. However, parents who rely solely on this tub might have difficulties when away from the tub, and only a conventional baby tub or adult tub is available.

Accessories, such as bathing slings, are available for use in conventional tubs. FIG. 3 shows such a sling. The sling provides an inclined surface to support the baby, and a fabric surface that is comfortable and can be washed. This sling is placed in a tub, to support the baby while bathing, as shown in FIG. 4. However, these slings keep the baby at least partially submerged in the water at all times, are not contoured for a baby's comfort, and are not adjustable. They offer little more than an inclined surface for the infant

SUMMARY OF THE INVENTION

The present invention is a bathing apparatus. In an exemplary application, the present invention is suitable for supporting an infant while the apparatus is placed in a bathtub. The term "infant", as used herein, refers to babies of any age at which bathing by an adult is required, and is not meant to be otherwise restrictive. Likewise, the bathtub in which the apparatus is intended to be placed can be a bathtub that is specifically designed for infants, such as a portable plastic bathtub. However, the bathtub can also be a full-sized standard tub or any other vessel that can be used as a tub for bathing an infant, without restriction.

According to an exemplary embodiment of the present invention, a support apparatus for placement within a bath tub includes a base, a frame attached to the base, and a cover removably attached to the frame. The frame has an upper frame portion, a lower frame portion, and a brace portion. The cover has an indented shape for supporting a human body.

The base can include an upper surface and an underside, and a surface area of the underside can have an index of sliding friction that is greater than an index of sliding friction of the upper surface. The base can have at least one vertical perforation. At least part of the frame can be removably attached to the base.

The base can include a front base portion and a rear base portion, and the brace portion of the frame can be attached to the rear base portion and to the upper frame portion. In this case, the apparatus can also include at least one junction member, and the brace portion of the frame and the upper frame portion can be coupled together by the junction member(s). The brace portion of the frame can be pivotally attached to the rear base portion and to the at least one junction member, the at least one junction member can be slidably attached to the upper frame portion, and the upper frame portion can be pivotally attached to the front base portion. The lower frame portion can be pivotally attached to the front base portion. For example, if the junction members are first and second junction members and the upper frame portion includes a top frame portion and first and second bottom frame portions, the brace portion of the frame and the upper frame portion can be coupled together by the first and second junction members, the top frame portion can be pivotally connected to the first and second bottom frame portions via the first and second junction members, and the first and second bottom frame portions can be coupled to the front base portion.

Likewise, if the base includes a front base portion and a rear base portion, the lower frame portion can be pivotally attached to the front base portion. Also, if the apparatus includes first and second junction members, the upper frame portion includes a top frame portion and first and second bottom frame portions, and the base includes a front base portion and a rear base portion, then the top frame portion can be pivotally connected to the first and second bottom frame portions via the respective first and second junction members, and the first and second bottom frame portions can be coupled to the front base portion.

The cover can include at least one fabric, an elastic material, or a padded material, or any combination of these. At least part of the cover can be inflatable. At least part of the cover can have a contoured shape. The cover can have a lowest portion that is positioned at a height that is higher than a height of the upper surface of the base.

According to another aspect of the present invention, an apparatus for supporting an infant in a bathtub includes a base, a fabric frame, a frame support, and a fabric cover. The base has a peripheral structure and an inner aperture. The fabric frame defines first and second planes forming a frame angle, and is coupled to the base at the frame angle. The frame support is coupled to the base and to the fabric frame. The fabric cover is removably attached to the fabric frame.

According to one exemplary embodiment, the fabric frame can include first and second U-shaped pieces defining the respective first and second planes. The first U-shaped piece can be pivotally attached to the base. The base can include at least one flange that supports the first U-shaped piece at a front angle with respect to the base. Straight ends of the second U-shaped piece can be coupled to the base. The base can include at least one footing that couples the second U-shaped piece at a rear angle with respect to the base. The frame support can be coupled to the second U-shaped piece. The frame support can be pivotally coupled to the base, and slidably coupled to the second U-shaped piece. The frame support can be pivotally coupled to the second U-shaped piece.

According to another exemplary embodiment, the fabric frame can include a first U-shaped piece, a second U-shaped piece, and first and second spanner pieces; the first U-shaped piece defines the first plane, and the first and second spanner pieces are coupled to extend the second U-shaped piece and together with the second U-shaped piece define the second plane. The first U-shaped piece can be pivotally attached to the base. The base can include at least one flange that supports the first U-shaped piece at a front angle with respect to the base. The first and second spanners can be coupled to the base. The base can include first and second footings that couple the respective first and second spanners at a rear angle with respect to the base. The frame support can couple the first and second spanners to the second U-shaped piece.

The frame support can be pivotally coupled to the base. The frame support can include a first linkage that couples the first spanner to the second U-shaped piece and a second linkage that couples the second spanner to the second U-shaped piece. The first and second linkages can be pivotally coupled to the second U-shaped piece. The frame support can include a brace that is pivotally coupled to the first and second linkages, and which is removably coupled to the base. The base can include a lip against which the brace is disposed. The first and second spanners can be pivotally coupled to the respective first and second linkages.

The fabric cover can include at least one pocketed portion that fits over part of the fabric frame. For example, the fabric cover can include a first pocketed portion that fits over a front end of the fabric frame, and a second pocketed portion that fits over a back end of the fabric frame. The second pocketed portion can include a headrest, which can be contoured and can include a foam material, or can be inflatable.

The fabric cover can include at least one mesh panel, such as at least one main mesh panel and two side mesh panels connected to the main mesh panel, defining an interior volume of the fabric cover having an upper edge. The fabric cover can also include a foam border covering at least a portion of the upper edge of the interior volume.

BRIEF DESCRIPTION OF THE DRAWINGS

The present invention is illustrated by way of example and not limitation in the figures of the accompanying drawings in which like references indicate similar elements, and in which.

DESCRIPTION OF THE INVENTION

The present invention is a bathing apparatus, suitable for bathing infants.

Figure 1:
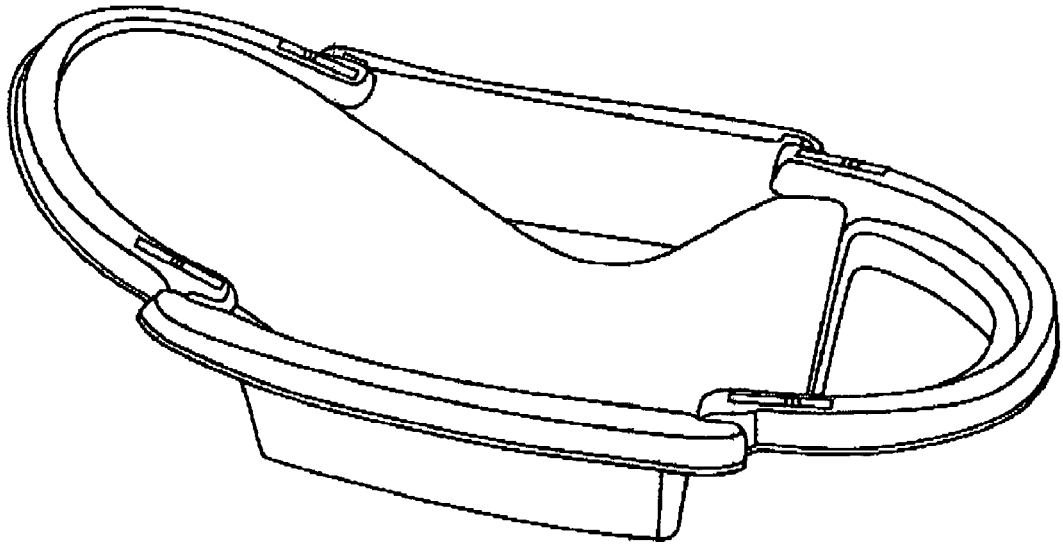
FIG. 1 Prior Art
FIG. 1 shows a prior art bathing apparatus, including a tub and liner.
Figure 2:
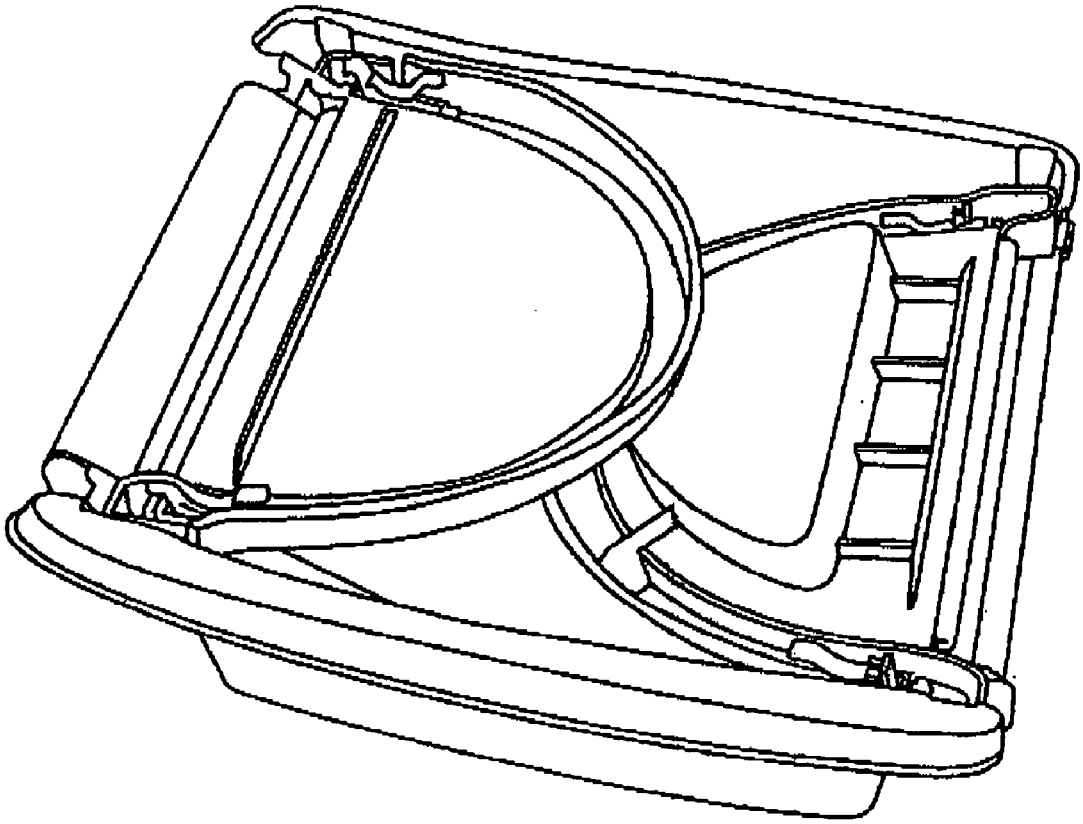
FIG. 2 Prior Art
FIG. 2 shows the prior art bathing apparatus of FIG. 1, in a folded position.
Figure 3:
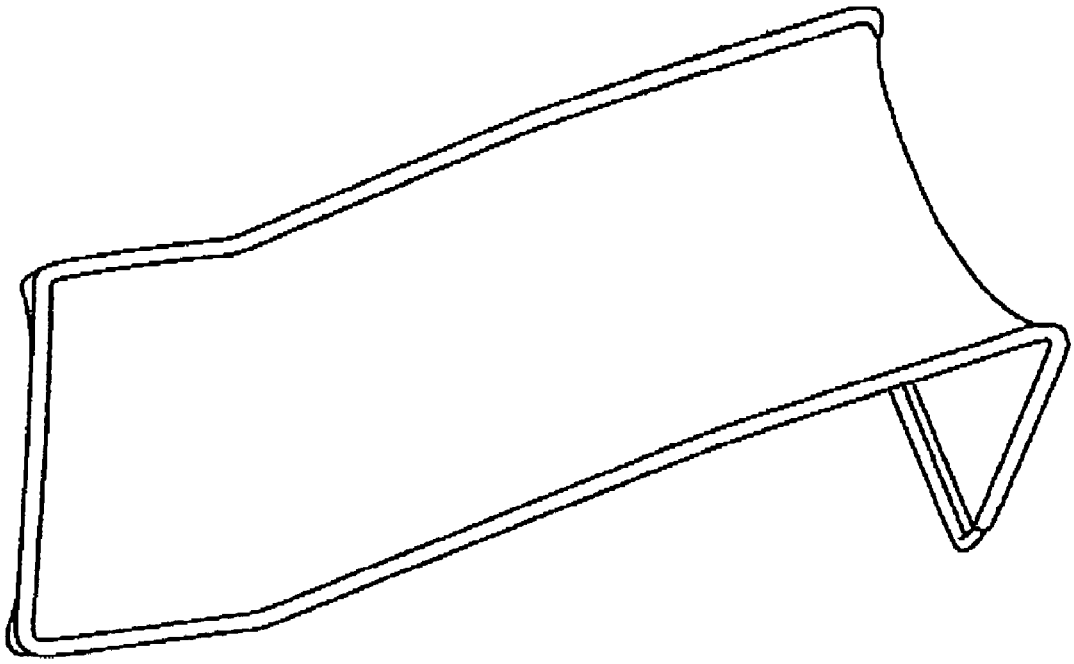
FIG. 3 Prior Art
FIG. 3 shows another prior art bathing apparatus designed for placement within a tub.
Figure 4:
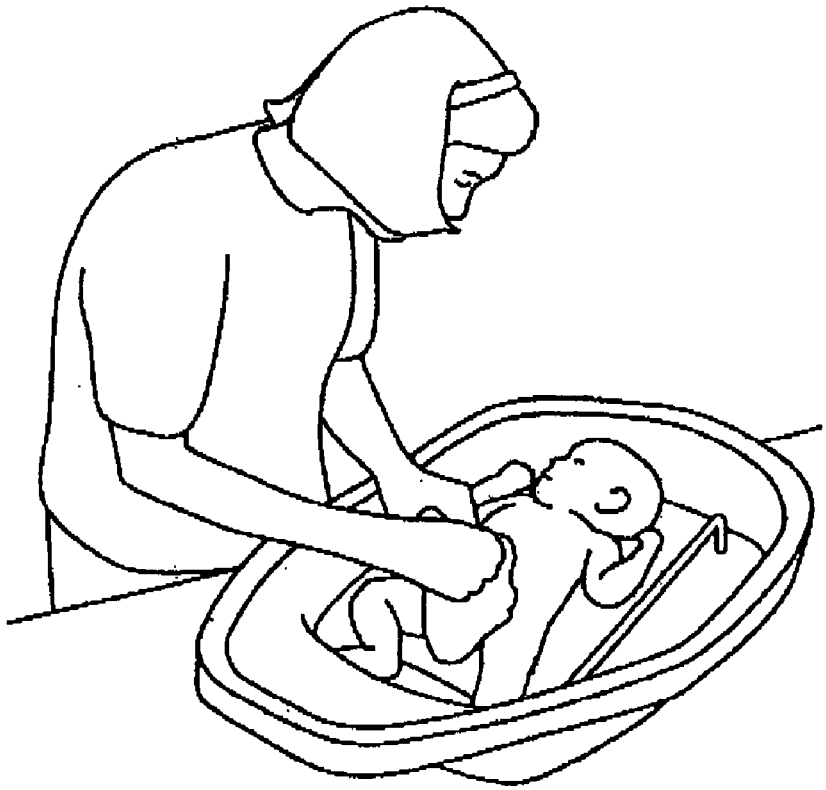
FIG. 4 Prior Art
FIG. 4 shows the prior art bathing apparatus of FIG. 3, placed within a bathing tub.
Figure 5:
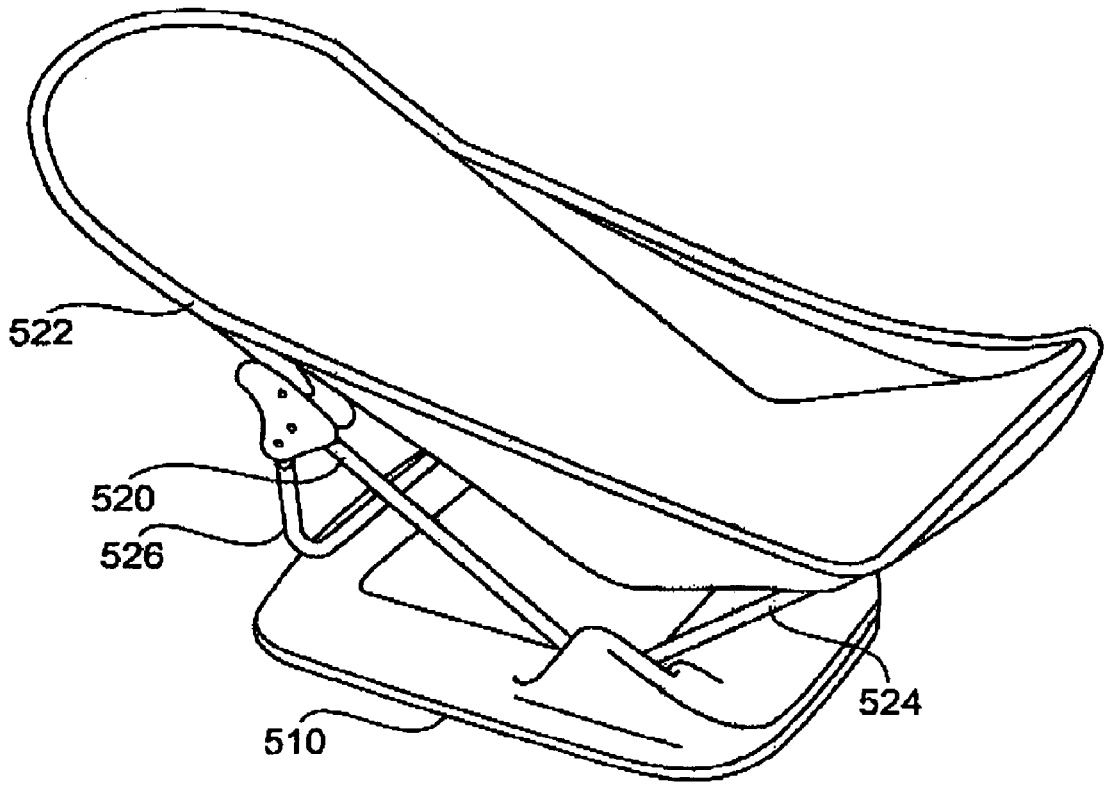
FIG. 5 illustrates an exemplary embodiment of the present invention.

According to an exemplary embodiment, the present invention is a support apparatus for placement within a bath tub. As shown in FIG. 5, such an apparatus includes a base 510 to provide stable support for the apparatus. A frame 520 is connected to the base 510. The frame 520 has an upper frame portion 522, a lower frame portion 524, and a brace portion 526. A cover 530 is removably attached to the frame 520 and forms an indented shape for supporting an infant.

Figure 6:
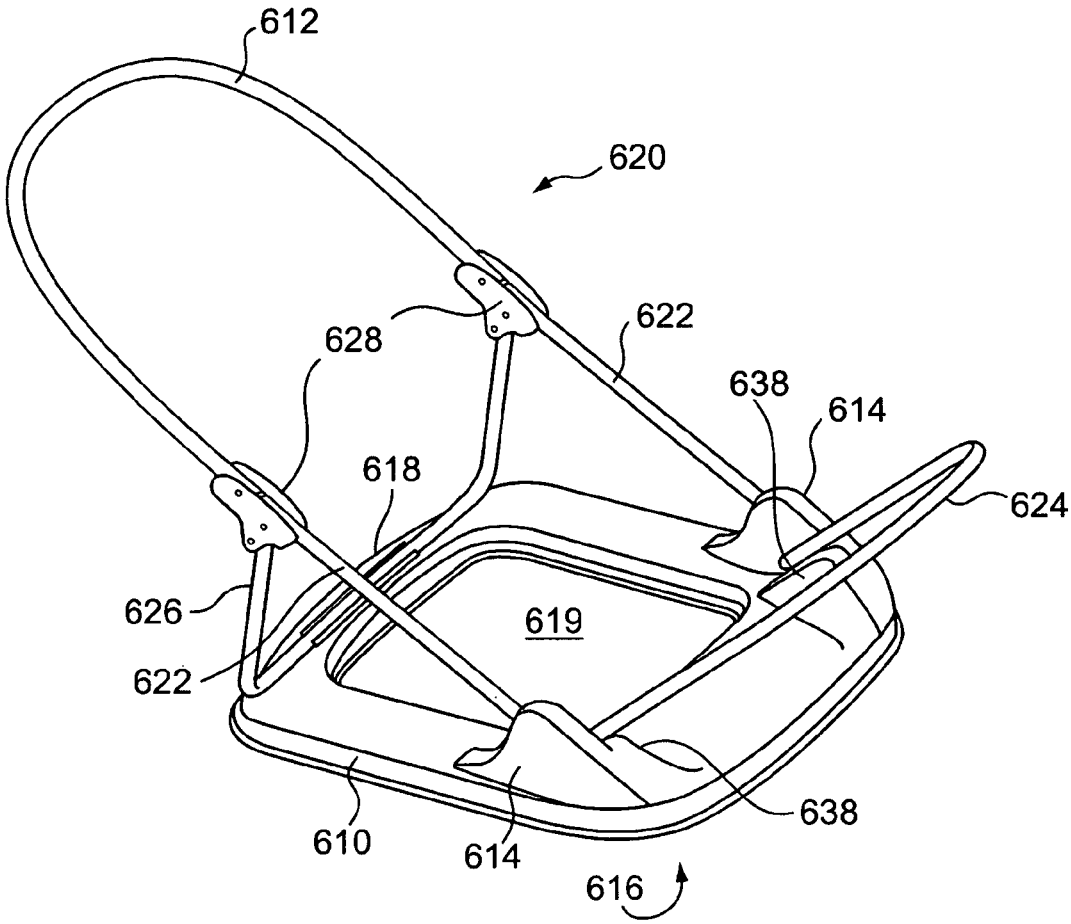
FIG. 6 illustrates an exemplary embodiment of the present invention, with the cover removed.
Figure 7:
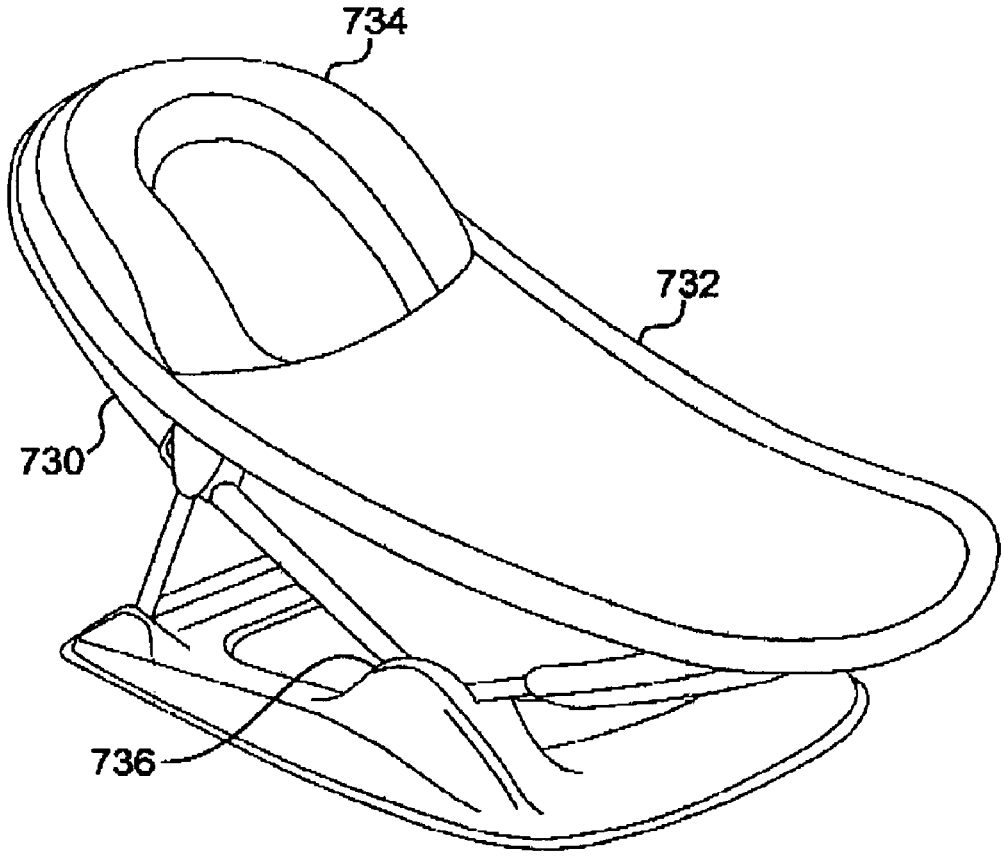
FIG. 7 illustrates another exemplary embodiment of the present invention.

Reference is now made to FIGS. 6 and 7.

According to an exemplary aspect of the invention, the base 610 is made from a lightweight material such as plastic. The underside 616 of the base 610 preferably includes an anti-skid surface to help prevent the base 610 from slipping on a wet surface. Thus, some type of anti-skid material having a higher index of sliding friction can be applied to the underside 616, such as by coating the surface or by adding a layer or appliqués of material such as rubber.

Preferably, the base 610 has at least one perforation 619 to make it easier to place the apparatus in a tub filled with water, and to make the apparatus lighter in weight and less costly to manufacture. As shown, the base 610 includes material around the periphery, and an aperture through an inner portion. Other configurations are contemplated, such as a grid arrangement or other structure having at least one vertical perforation.

Generally, in preferred embodiments, at least part of the frame 620 is removably attached to the base. This provides convenience in storage and cleaning of the apparatus. As shown in this example, a brace or other frame support 626 is attached to the rear portion of the base and to the upper portion of the frame. Also as shown in this embodiment, the brace 626 and the upper portion of the frame are coupled together by at least one junction member or other linkage device 628.

As shown, the brace 626 can be pivotally attached to the rear portion of the base and to the junction members 628, which can be slidably attached to the upper portion of the frame, and the upper portion of the frame can be pivotally attached to the front portion of the base. This arrangement allows the frame 620 to be adjustable in reclining angle, to accommodate the individual comfort requirements and various proportions of different infants. Likewise, lower portion of the frame is preferably pivotally attached to the front portion of the base such that lower portion of the frame is also adjustable.

For ease of portability, preferred embodiments of the frame 620 are also foldable. As shown, a top portion of the upper frame is pivotally coupled to the bottom portion of the upper frame, by way of the junction members 628.

As shown in FIG. 7, at least part of the cover 730 is constructed from at least one fabric. This fabric can be selected based on any of a number of factors, including its strength, durability, and comfort. Preferably, at least part of the cover 730 is formed of a material having elastic properties, to provide a secure fit in engaging the frame and for the comfort of the infant. Also for the infant's comfort, the cover 730 has a contoured shape when engaged with frame 620. For example, the exemplary embodiment shown in FIG. 7 includes a cover 730 that forms a "scoop" shape to cradle the infant in the bather. In this embodiment, the lowest portion of the cover 730 is positioned at a certain height above the base, to allow the infant to sit above a certain depth of standing water, such as when rinsing the infant.

Referring again to FIGS. 6 and 7, the apparatus of the present invention will be described in more detail. As shown, the apparatus includes a stable base 610, a frame 620 that is at least partially removably attached to the base 610, and a fabric cover 730 that is fitted over the frame 620, and can be removed for cleaning or replacement. The fabric cover 730 preferably is contoured, that is, it is fabricated from multiple panels of fabric to provide a three-dimensional, cradling shape, which is supported by the shape of the frame. The frame dimensions allow the lowest portion of the fabric cover 730 to be disposed at a certain height over the base 610, and therefore over the surface of the water, if desired, while bathing the infant.

FIG. 6 shows the base 610 and the frame 620 without the fabric cover. The base can be a molded plastic piece with a low profile and a footprint having roughly similar lateral and transverse dimensions. Preferably, the base footprint has an open inner area, to allow easy placement in a tub when the tub already has water in it.

The frame can be constructed of, for example, lightweight tubing made of plastic, or of aluminum or other metal. The frame includes a first U-shaped piece 612 that extends from footings 614 on the base 610. The first U-shaped piece 612 extends at an angle from the plane of the base, to provide an incline for the fabric cover. The first U-shaped piece 612 can be pivotally coupled to the footings 614, to allow for adjustment of the rearward angle. The first U-shaped piece 612 is supported by a frame support 626, which includes a linkage device 628 that is coupled to the first U-shaped piece 612. By sliding the linkage device 628 along the length of the first U-shaped piece 612, support is provided while the angle at which the first U-shaped piece 612 inclines is adjusted. The frame support 626 includes a brace that is pivotally coupled to the base 610. This pivotal coupling can be provided by fitting the brace to a slot in the back portion of the base 610, fitting the brace through a channel provided through the back end of the base 610, or positioning the brace against a lip 618 on the back portion of the base 610. As shown, the brace can be a U-shaped piece.

Alternatively, the first U-shaped piece 612 can include three pieces: a smaller U-shaped piece, extending outward from the linkage devices 628, and two straight extensions or spanners 622 that connect the linkage devices 628 to the front portion of the base 610, preferably at the footings 614 described above. In this embodiment, the smaller U-shaped piece, the spanners 622, and the brace can all be pivotally coupled to the linkage devices 628. Thus, folding the smaller U-shaped piece over onto the spanners 622 and folding the brace under the spanners 622 allows the apparatus to be put in a compact configuration for storage or transportation. The base 610 can include recessed portions along the sides to accommodate the folded-under brace, and the spanners 622, pivotally connected at the footings 614, can be folded down as well. The frame 620 includes a second U-shaped piece 624, which is pivotally connected at the front end of the base 610. The base 610 preferably includes two flanges 638 on which the second U-shaped piece 624 is supported. The second U-shaped piece 624 can be folded back for storage or transportation.

The fabric cover 730 is stretches over the frame, and therefore at least partially assumes the shape of the frame. The cover 730 also has a shape of its own, which partially defines the receiving area of the bather support. The fabric cover 730 can be made from any material, or any combination of materials, including cotton, nylon, and mesh. Preferably, the material is at least somewhat stretchy, so that it can be fitted snuggly over the frame. Further, the periphery of the fabric cover 732 can be elasticized, for a sure fit, and can be padded, for the comfort of the infant. Preferably, the material from which the fabric cover 730 is constructed is washable. The fabric cover can be formed from several flat panels that are attached together, preferably sewn, to provide a three-dimensional shape. Pockets can be formed in the cover at the front and rear, to accept the ends of the U-shaped pieces 612, 624 of the frame 620, to hold the cover 730 in place.

As shown in FIG. 7, additional features can be added to the fabric cover 730. For example, a contoured headrest 734 can be provided. This headrest 734 can be fabricated of a padded material, such as a foam rubber. Alternatively, the headrest 734 can be made of PVC, vinyl, or other material such that the headrest can be inflated, by way of a valved opening, pump, or other means.

Therefore, I claim:

1. A support apparatus for placement within a bath tub, comprising:

a base;

a fame attached to the base, wherein the frame has an upper frame portion, a lower frame portion, and a brace portion; and a cover removably attached to the frame, wherein the cover has an indented shape for supporting a human body;

wherein the base includes a front base portion and a rear base portion, and the brace portion of the frame is attached to the rear base portion and to the upper frame portion;

further comprising at least one junction member, wherein the brace portion of the frame and the upper frame portion are coupled together by the at least one junction member;

wherein the brace portion of the frame is pivotally attached to the rear base portion and to the at least one junction member the at least one junction member is slidably attached to the upper frame portion, and the upper frame portion is pivotally attached to the front base portion; and wherein the at least one junction member comprises first and second junction members, the brace portion of the frame and the upper frame portion are coupled together by the first and second junction members, the upper frame portion includes a top frame portion and first and second bottom frame portions, the top frame portion is pivotally connected to the first and second bottom frame portions via the first and second junction members, and the first and second bottom frame portions are coupled to the front base portion.

2. The apparatus of claim 1, wherein the base includes an upper surface and an underside, wherein a surface area of the underside has an index of sliding friction that is greater than an index of sliding friction of the upper surface.

3. The apparatus of claim 1, wherein the base has at least one vertical perforation.

4. The apparatus of claim 1, wherein at least part of the frame is removably attached to the base.

5. The apparatus of claim 1, wherein the lower frame portion is pivotally attached to the front base portion.

6. The apparatus of claim 1, wherein the base includes a front base portion and a rear base portion, and the lower frame portion is pivotally attached to the front base portion.

7. The apparatus of claim 1, further comprising first and second junction members;

wherein the upper frame portion includes a top frame portion and first and second bottom frame portions, the top frame portion is pivotally conned to the first and second bottom frame portions via the respective first and second junction members, the base includes a front base portion and a rear base portion, and the first and second bottom frame portions are coupled to the front base portion.

8. The apparatus of claim 1, wherein the cover includes at least one fabric.

9. The apparatus of claim 1, wherein the cover includes an elastic material.

10. The apparatus of claim 1, wherein the cover includes a padded material.

11. The apparatus of claim 1, wherein at least part of the cover is inflatable.

12. The apparatus of claim 1, wherein at least part of the cover has a contoured shape.

13. The apparatus of claim 1, wherein the cover has a lowest portion that is positioned at a height that is higher than a height of the upper surface of the base.

14. An apparatus for supporting an infant in a bathtub, comprising:

a base having a peripheral structure and an inner aperture;

a fabric frame defining first and second planes forming a frame angle, wherein the fabric frame is coupled to the base at the frame angle;

a frame support coupled to the base and to the fabric frame; and a fabric cover that is removably attached to the fabric frame;

wherein the fabric frame comprises a first U-shaped piece, a second U-shaped piece, and first and second spanner pieces, wherein the first U-shaped piece defines the first plane, and the first and second spanner pieces are coupled to extend the second U-shaped piece and together with the second U-shaped piece define the second plane; and wherein the frame support couples the first and second spanners to the second U-shaped piece.

15. The apparatus of claim 14, wherein the fabric frame comprises first and second U-shaped pieces defining the respective first and second planes.

16. The apparatus of claim 15, wherein the first U-shaped piece is pivotally attached to the base.

17. The apparatus of claim 15, wherein the base includes at least one flange that supports the first U-shaped piece at a front angle with respect to the base.

18. The apparatus of claim 15, wherein straight ends of the second U-shaped piece are coupled to the base.

19. The apparatus of claim 18, wherein the base includes at least one footing that couples the second U-shaped piece at a rear angle with respect to the base.

20. The apparatus of claim 15, wherein the frame support is coupled to the second U-shaped piece.

21. The apparatus of claim 20, wherein the frame support is pivotally coupled to the base, and is slidably coupled to the second U-shaped piece.

22. The apparatus of claim 21, wherein the frame support is pivotally coupled to the second U-shaped piece.

23. The apparatus of claim 14, wherein the first U-shaped piece is pivotally attached to the base.

24. The apparatus of claim 14, wherein the base includes at least one flange that supports the first U-shaped piece at a front angle with respect to the base.

25. The apparatus of claim 14, wherein the first and second spanners are coupled to the base.

26. The apparatus of claim 25, wherein the base includes first and second footings that couple the respective first and second spanners at a rear angle with respect to the base.

27. The apparatus of claim 14, wherein the frame support is pivotally coupled to the base.

28. The apparatus of claim 14, wherein the frame support includes a first linkage that couples the first spanner to the second U-shaped piece and a second linkage that couples the second spanner to the second U-shaped piece.

29. The apparatus of claim 28, wherein the first and second linkages are pivotally coupled to the second U-shaped piece.

30. The apparatus of claim 28, wherein the frame support includes a brace that is pivotally coupled to the first and second linkages, and which is removably coupled to the base.

31. The apparatus of claim 30, wherein the base includes a lip against which the brace is disposed.

32. The apparatus of claim 30, wherein the first and second spanners are pivotally coupled to the respective first and second linkages.

33. The apparatus of claim 14, wherein the fabric cover includes at least one pocketed portion that fits over part of the fabric frame.

34. The apparatus of claim 33, wherein the fabric cover includes a first pocketed portion that fits over a front end of the fabric frame, and a second pocketed portion that fits over a back end of the fabric frame.

35. The apparatus of claim 34, wherein the second pocketed portion includes a headrest.

36. The apparatus of claim 35, wherein the headrest is contoured.

37. The apparatus of claim 36, wherein the headrest includes a foam material.

38. The apparatus of claim 35, wherein the headrest is inflatable.

39. The apparatus of claim 14, wherein the fabric cover includes at least one mesh panel.

40. The apparatus of claim 39, wherein the fabric cover includes at least one main mesh panel and two side mesh panels connected to the main mesh panel, defining an interior volume of the fabric cover having an upper edge.

41. The apparatus of claim 40, wherein the fabric cover further includes a foam border covering at least a portion of the upper edge of the interior volume.

* * * * *